United States Patent [19]

Lee et al.

[11] Patent Number: 4,643,709

[45] Date of Patent: Feb. 17, 1987

[54] METHOD OF OPERATING NOZZLE CENTRIFUGES

[75] Inventors: Chie-Ying Lee, Pleasant Valley; James D. West; Gerald F. Cole, both of Poughkeepsie, all of N.Y.

[73] Assignee: Alfa-Laval, Inc., Poughkeepsie, N.Y.

[21] Appl. No.: 729,241

[22] Filed: May 1, 1985

[51] Int. Cl.[4] ..... B04B 5/00

[52] U.S. Cl. ..... 494/37; 494/35

[58] Field of Search ..... 494/35, 37, 42, 56, 494/84, 85, 4; 210/782, 781; 422/72

[56] References Cited

U.S. PATENT DOCUMENTS

| | | | |
|---|---|---|---|
| 2,488,747 | 11/1949 | Strezynski | 494/35 |
| 3,750,940 | 8/1973 | Nilsson | 494/35 |
| 3,752,389 | 8/1973 | Nilsson | 494/35 |
| 4,475,897 | 10/1984 | Bradtmoller | 494/35 |
| 4,505,697 | 3/1985 | Lee | 494/35 |

*Primary Examiner*—Robert W. Jenkins

*Attorney, Agent, or Firm*—Cyrus S. Hapgood

[57] ABSTRACT

In centrifuges for separating solids-liquid slurries and which discharge concentrated solids through nozzles at the periphery of the centrifugal bowl or rotor, it is necessary to maintain a feed or influent rate at least as great as the nozzle discharge rate. According to the present invention, this is accomplished by driving from the centrifuge drive train a pumping means for returning concentrated solids from the nozzles to the centrifuge for recycling through the bowl.

11 Claims, 4 Drawing Figures

METHOD OF OPERATING NOZZLE CENTRIFUGES

The present invention relates to the separation of a solids-liquid slurry in a centrifuge of the type having a centrifugal rotor with peripheral nozzles for discharging a separated component of concentrated solids. More particularly, the invention relates to a method of operating the centrifuge when concentrate solids are recycled through the rotor by way of a return line from the nozzles.

BACKGROUND OF THE INVENTION

It is general knowledge in the field that for centrifuges having a centrifugal bowl or rotor, with peripheral discharge nozzles, it is necessary to maintain a feed or influent rate equivalent to, or greater than, the discharge rate of the nozzles. If the feed rate is less than the nozzle discharge rate, the centrifugal bowl will eventually be evacuated of process material. This is an extremely hazardous condition in that any imbalance, such as that caused by plugged nozzles or uneven solids build-up in the bowl, will be accentuated by the high centrifugal forces. The imbalance condition under these circumstances can cause major equipment damage or even personal injury if the centrifuge should come apart.

A number of safety measures have been employed to avoid the potential hazards caused by driving an evacuated centrifugal bowl. These measures usually take the form of an emergency flush system. This type system uses a flow sensing device in the feed and/or effluent line. When the flow sensing device measures a low flow rate, or loss of flow, it triggers an emergency flush system for flooding the bowl. The flush system is typically (1) a pressurized line such as a water supply line, (2) a head tank containing flush liquid, or (3) a head tank containing clarified process fluid (centrifuge effluent).

Another emergency system has a water brake for emergency shut-down. This type of emergency measure uses a jacket or channellike structure which surrounds the centrifugal bowl or rotor. If an out-of-balance situation occurs, the jacket is flooded with water or some other liquid. The water acts as a brake to stop the bowl quickly. This method is usually incorporated with one of the above bowl-flooding systems since the water-brake does not counteract an imbalance condition.

The foregoing systems are disadvantageous for a number of reasons. For the first system, a large supply of pressurized water must be available to maintain a "flooded-bowl" condition while the bowl is rotating. If the centrifuge is shut-down due to loss in feed, the flush water must maintain the flooded-bowl condition until the bowl has ceased to rotate. This typically takes several minutes. Without an external means of braking (such as the water brake), the rotating bowl may take 10,20,30 minutes or more to stop.

The systems using a head tank would also require a large amount of fluid as stated above. For example, a typical industrial centrifuge with a nozzle discharge rate of 35 gpm has a deceleration time of thirty minutes, unbraked. The flush system would require a head tank of 1000 gallons to satisfy the nozzle discharge rate during shut-down.

Each of the above systems also requires some type of flow monitoring device. This device is needed to detect the loss of feed which will result in insufficient flow to satisfy the nozzles. To operate the solenoid valve for the flush liquid, an appropriate control system must be installed between the valve and the sensing device.

For industrial plant applications, the disadvantages of the foregoing systems are:

1. Floor space and overhead are needed for a head tank installation; or a pressurized, high volume fluid supply line is needed in lieu of the head tank.
2. A large volume of flush liquid is needed for shut-down.
3. A reliable flow sensing device and control system are needed.

In addition to the facility requirements, systems using these prior measures have inherent operational problems. Systems using pressurized water for flush liquid may lose fluid pressure or volume. For systems using centrifuge effluent for flush liquid, solids settling in pipes or thixotropic fluids may cause pipe blockage—preventing the emergency flush system from functioning. In the control system, flow sensing devices may foul, falsely giving a "no-flow" condition. Or worse, the sensing device may read full flow while actually there is no flow. Solenoid valves may malfunction due to mechanical or control problems. For pneumatic controls, loss of air pressure may mean loss of system control.

Since automatic flush control valves must open on power loss, there is usually a manual valve that can turn off the flush system when the equipment is not operating, or when power is off. Human error would be another factor in this case. Failure to reopen the manual valve on the flush line can be disasterous if an emergency should occur after the centrifuge is restarted.

For some field applications, such as those found in the oil drilling industry, the necessary facilities, namely, tank space, pressurized supply water, and large volumes of flush liquid, are often not readily available. Under these circumstances, a different emergency system is needed for safe centrifuge operation.

SUMMARY OF THE INVENTION

According to the invention, concentrated solids from the nozzle discharge of the centrifugal bowl are recycled through the bowl by way of a return line leading to the bowl inlet through which the slurry to be separated is fed. This return line includes pumping means driven from the drive train through which the centrifugal bowl is driven. Thus, the pumping means are operated at all times while the centrifugal bowl is rotating, and the bowl nozzles are satisfied at all times while the centrifuge is in operation, including start-up as well as shut-down.

The return line may be provided with a valve for periodically purging the line of concentrated solids.

In the preferred method, concentrated solids are withdrawn from the return line to reduce the rate at which they are recycled through the centrifugal bowl; and the rate of this withdrawal is controlled to maintain a substantially constant concentration of solids in the separated component discharged from the nozzles. Preferably, the return line includes a container having a weir outlet over which this withdrawal is effected and also having a second outlet leading to the centrifugal bowl or rotor. Control of the withdrawal rate is then effected by decreasing the flow rate through the second outlet in response to an increase in the concentration of solids returning to the bowl, thereby increasing the withdrawal rate, and by increasing the flow rate through the second outlet in response to a decrease in said concentration, thereby decreasing the rate of said withdrawal.

The effluent (liquid component) separated in the centrifugal bowl or rotor is, of course, discharged separately from the concentrated solids. It may be collected in a tank and delivered to a desired destination by an effluent pump. If the latter pump should shut down accidently during operation of the centrifuge, as in case of power failure, effluent from the tank preferably overflows a weir and is added to the discharge from the nozzles to reduce the solids concentration in the return line to the centrifuge. Excess liquid in the return line can escape over the afore-mentioned weir outlet from the return line.

During start-up and shut-down of the centrifuge, effluent from the centrifugal bowl may be directed into the return line to supplement the solids discharged from the nozzles, thereby insuring an adequate inflow to the bowl.

THE DRAWINGS

For a better understanding of the invention, reference may be had to the following detailed description in conjunction with the accompanying drawings, in which FIG. 1 is a schematic view of a system for practicing the new method;

DETIALED DESCRIPTION

Figure 1:
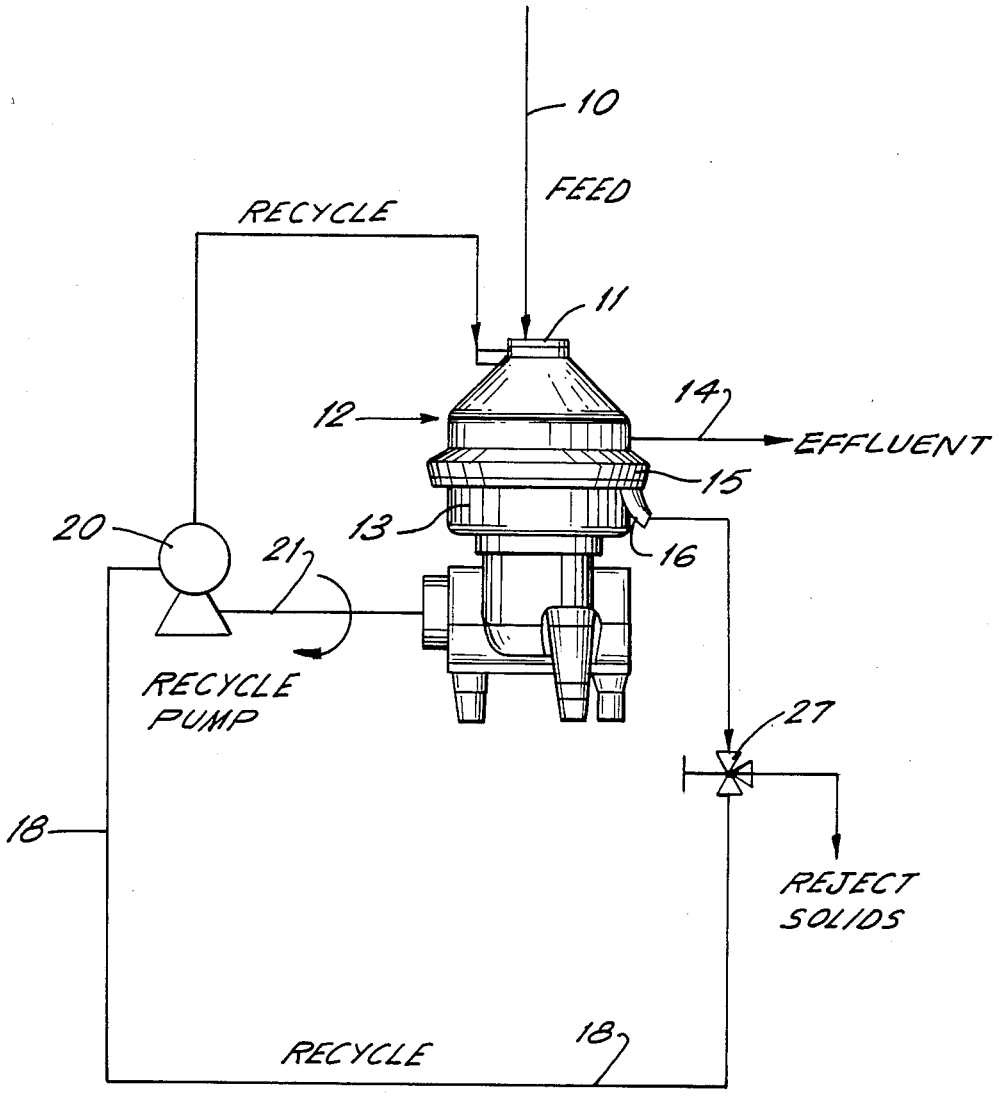

Referring to FIG. 1, a slurry of solids and liquid is delivered through feed line 10 to the inlet 11 of a nozzle centrifuge 12 of the disc type. As is well known in the art, such centrifuges include a stationary frame 13 which houses a centrifugal bowl or rotor (not shown). The latter is driven to rotate on a vertical axis and forms a separating chamber where the slurry from inlet 11 is separated in the spaces between conical discs. The separated liquid or effluent, which is the lighter component, discharges as shown at 14 while the concentrated solids discharge through peripheral nozzles of the bowl into a receiver 15 having an outlet 16.

Figure 3:
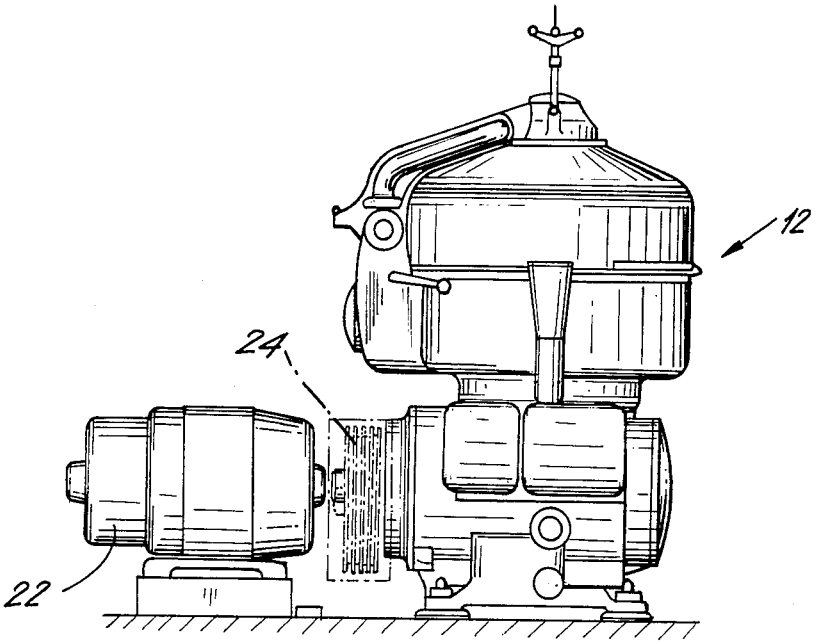
FIG. 3 is a front view of a centrifuge with a pump drive pulley installed on the main drive shaft of the centrifuge.
Figure 4:
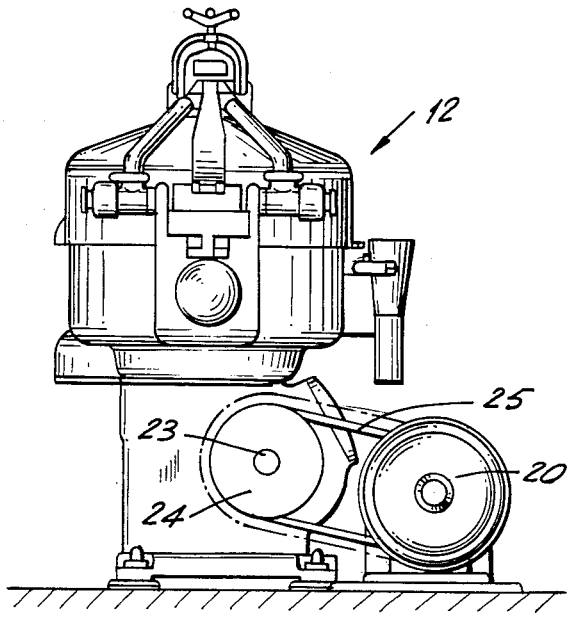
FIG. 4 is a side view of the centrifuge in FIG. 3, with the motor removed.

From outlet 16 the solids pass through a line 18 having a pump 20 for returning the solids to the centrifuge inlet 11. Pump 20 is driven directly through a suitable transmission 21 from the drive train for the centrifugal bowl. More particularly, as shown in FIGS. 3 and 4, the drive train includes a motor 22 connected through a horizontal shaft 23 and suitable gearing to the usual vertical spindle (not shown) on which the centrifugal bowl is mounted. The transmission 21 (FIG. 1) includes a pulley 24 splined to shaft 23 and by which pump 20 is driven through a belt 25 (FIGS. 3 and 4). Of course, the transmission may take other forms, such as a chain drive, gear drive, pneumatic drive, etc.

In FIG. 1, the return line 18 also includes a three-way valve 27 which can be opened periodically to remove solids from the line.

Figure 2:
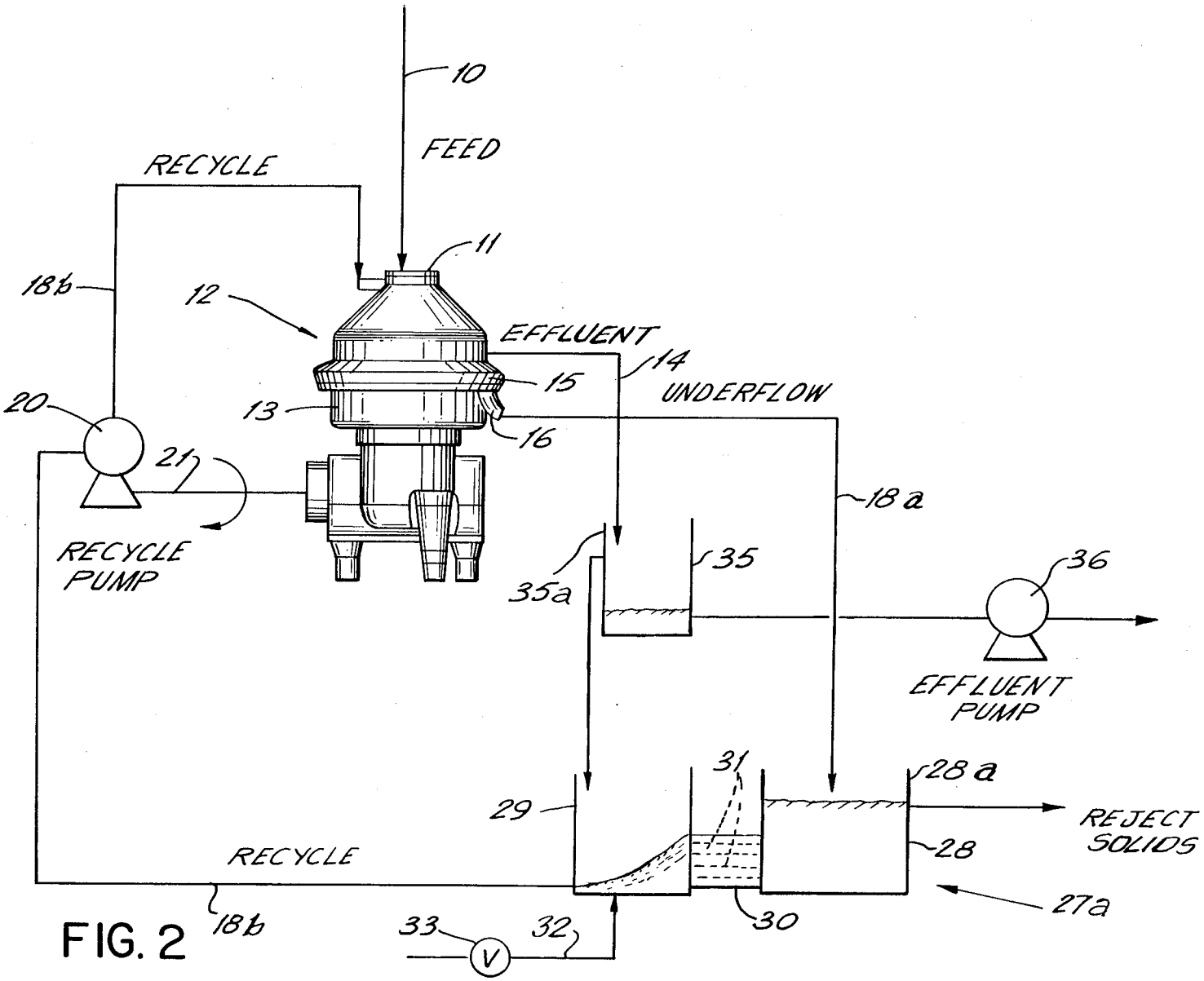
FIG. 2 is a similar view of a system for practicing a preferred form of the new method.

In FIG. 2, each part having a corresponding part in FIG. 1 is given the same reference numeral as in FIG. 1.

Referring to FIG. 2, the solids return line includes not only the pump 20 but also a control means 27*a*. The latter comprises a container 28 to which the underflow solids are delivered through pipe line 18*a* from centrifuge outlet 16. Container 28 communicates with a second container 29 through a control device 30 having a series of passages 31. Each passage 31 imposes a substantial resistance to the flow from container 28 to container 29, the resistance increasing as the underflow acquires greater viscosity due to higher solids content. From the lower part of container 29 a pipe line 18*b* leads through pump 20 to centrifuge inlet 11. A flush line 32 having a valve 33 leads through the bottom of container 29.

Discharge line 14 for the separated effluent (lighter component) leads to a container 35, from which the effluent is delivered to a desired destination by a pump 36. Container 35 has a weir 35*a* which allows overflow of effluent into container 29.

In starting the centrifuge, motor 22 is started to drive pump 20 and the centrifugal bowl, to which feed is delivered through line 10. The bowl is brought up to speed only gradually; and during the acceleration period, separated effluent is delivered to container 35 while the underflow (separated solids more or less concentrated) is delivered to container 28. As the bowl picks up speed, all of the underflow is returned to the bowl by pump 20, which is driven at increasing speed. Thus, the bowl nozzles are satisfied as the bowl is brought to normal operating speed.

As the centrifuging continues, the underflow solids become more and more concentrated due to their recycling through the bowl. As the solids concentration increases, the flow resistance imposed by control device 30 increases so that underflow in container 28 will eventually reach a level above the uppermost passage 31 and discharge over a weir 28*a* as reject solids. The desired consistency or concentration of solids is attained when the rate of underflow discharge over weir 28*a* is such as to maintain a certain rate of underflow return by pump 20. Thereafter, if the solids concentration increases for any reason, the resulting increased flow resistance through control device 30 will reduce the return rate to the centrifugal bowl and thereby counteract the increased solids concentration. Conversely, any decrease in the solids concentration will cause control device 30 to increase the return rate to the bowl so as to counteract the decreased concentration.

The control passages 31 are preferably provided by thin spaces between a series of horizontal plates arranged in a stack. The desired solids concentration to be maintained can be increased or decreased by increasing or decreasing, respectively, the total throughflow area provided by the passages, thereby increasing or decreasing, respectively, the underflow return rate.

In case of power failure, both the centrifuge drive mctor 22 and effluent pump 36 will shut down. However, recycle pump 20 will continue to operate at gradually reduced speed as the centrifugal bowl decelerates. Moreover, effluent will now accumulate in container 35 and discharge over weir 35*a* so as to enter container 29, thereby reducing the concentration of the solids returning through pump 20. Excess fluid in the recycle loop will discharge from container 28 over weir 28*a*. By powering recycle pump 20 directly from the centrifuge drive train, the recycle rate will decrease as the bowl speed decreases. Thus, the ratio between the recycle rate and the nozzle discharge rate will remain essentially constant.

When the centrifuging is to be terminated in normal fashion, both motors 20 and 36 are shut down; and after discontinuing the feed through line 10, the operation is similar to that described above.

If desired during start-up as well as shut-down, effluent pump 36 may be immobilized to cause overflow from container 35 to container 29, thereby directing effluent into the recycle loop.

In case of feed failure during normal operation, the centrifuge will continue to operate. The bowl nozzles will continue to be satisfied by the underflow return through the recycle loop including pump 20. Therefore, the need to flood the centrifugal bowl is eliminated. Heretofore, feed failure would create an emergency situation requiring centrifuge shut-down combined with bowl-flooding. Such shut-down is made unnecessary by the present invention, and the need for large volumes of flushing liquid is eliminated in all cases.

In some instances it may be desired to remove the solids from the recycle stream, as when the centrifuge is to be disassembled after shut-down. For this removal, a flush liquid may be injected into the recycle loop by opening valve 33 in line 32.

We claim:

1. In the operation of a nozzle-type centrifuge for the separation of a slurry into a concentrated solids component and an effluent component, the centrifuge including a centrifugal rotor, the method which comprises feeding said slurry to the rotor while driving the rotor through a drive train to effect said separation, separately discharging said components from the rotor, said concentrated solids component being discharged through nozzles at the peripheral portion of the rotor, recycling a stream of concentrated solids through the rotor from said nozzles by way of a return line including pumping means, and driving said pumping means from said drive train, whereby the rate of driving said pumping means is maintained directly proportional to the rate at which the rotor is driven.

2. The method of claim 1, in which the pumping means are driven from said drive train through a belt and pulley.

3. The method of claim 1, comprising also withdrawing concentrated solids from said return line during said recycling, and controlling the rate of said withdrawing to maintain a substantially constant concentration of solids in said solids component discharged from the nozzles.

4. The method of claim 3, in which the rate of said withdrawing is controlled by decreasing the recycling rate in response to an increase in the concentration of solids discharged through said nozzles, thereby increasing the rate of said withdrawing, and by increasing the recycling rate in response to a decrease in the concentration of said discharged solids, thereby decreasing the rate of said withdrawing.

5. The method of claim 4, in which said withdrawing is effected by discharging concentrated solids over a weir from a container included in said return line.

6. The method of claim 1, comprising also withdrawing concentrated solids from said return line during said recycling, said withdrawing being effected by discharging concentrated solids over a weir from a first container included in the return line.

7. The method of claim 6, comprising also passing effluent discharged from the rotor into a second container during said recycling while withdrawing effluent from the second container, causing effluent to overflow said second container while discontinuing said effluent withdrawing, and passing overflowing effluent from said second container to said return line.

8. The method of claim 7, in which said overflowing effluent is passed to the return line downstream from said first container.

9. The method of claim 1, comprising also directing effluent from the rotor into said return line during start-up of the centrifuge.

10. The method of claim 1, comprising also directing effluent from the rotor into said return line during shut-down of the centrifuge.

11. The method of claim 1, comprising also injecting a flushing liquid into said return line to displace solids therefrom.

* * * * *